US007169035B2

(12) United States Patent
Nireki et al.

(10) Patent No.: US 7,169,035 B2
(45) Date of Patent: Jan. 30, 2007

(54) COIN PAYOUT DEVICE UTILIZABLE IN VARIOUS DEVICES

(75) Inventors: Takao Nireki, Tokyo (JP); Katsunari Nishimura, Tokyo (JP)

(73) Assignee: Aruze Corp., Tokyo (JP)

( * ) Notice: Subject to any disclaimer, the term of this patent is extended or adjusted under 35 U.S.C. 154(b) by 83 days.

(21) Appl. No.: 10/885,617

(22) Filed: Jul. 8, 2004

(65) Prior Publication Data

US 2005/0063577 A1 Mar. 24, 2005

(30) Foreign Application Priority Data

Jul. 17, 2003 (JP) ..... 2003-276178
Nov. 12, 2003 (JP) ..... 2003-382997

(51) Int. Cl.
*G07D 1/00* (2006.01)

(52) U.S. Cl. ..... 453/18

(58) Field of Classification Search ..... 453/29, 453/30, 33, 34, 35, 63
See application file for complete search history.

(56) References Cited

U.S. PATENT DOCUMENTS 4,586,522 A * 5/1986 Taipale et al. ..... 453/10
5,238,446 A * 8/1993 le Hong et al. ..... 453/57
5,868,614 A * 2/1999 Hirano ..... 453/57
6,193,599 B1 * 2/2001 Kurosawa et al. ..... 453/57
6,319,126 B1 * 11/2001 Tamaki ..... 463/25

FOREIGN PATENT DOCUMENTS

JP 07-085333 A 3/1995

* cited by examiner

*Primary Examiner*—Patrick Mackey
*Assistant Examiner*—Mark J. Beauchaine
(74) *Attorney, Agent, or Firm*—Rader, Fishman & Grauer PLLC

(57) ABSTRACT

The coin payout device 1 according to the present invention is constructed from: the payout unit 20 paying out coins one by one, the payout unit 20 comprising the rotation plate 26 in which a plurality of coin openings 26*b* are formed along the circumference thereof, the drive motor 22 for driving the rotation plate 26 and the connector 30 for supplying electric power to the drive motor 22; the bucket 10 for storing coins; and the base 50 to which the payout unit 20 and the bucket 10 are detachably arranged. Here, the drive motor 22, which is arranged in the payout unit 20 through the latch mechanism, is prevented from dropping since the resilient deformable members 40, 40 constructing the latch mechanism are limited so as not to spread by the limit members 53 formed on the inner side walls of the recess portion 51 in the base 50 when the payout unit 20 is assembled to the base 50.

13 Claims, 4 Drawing Sheets

COIN PAYOUT DEVICE UTILIZABLE IN VARIOUS DEVICES

CROSS-REFERENCE TO THE RELATED APPLICATION(S)

This application is based upon and claims a priority from the prior Japanese Patent Application Nos. 2003-276178 and 2003-382997 filed on Jul. 17, 2003 and Nov. 12, 2003, respectively, the entire contents of which are incorporated herein by reference.

BACKGROUND OF THE INVENTION

1. Field of the Invention

The present invention relates to a coin payout device which stores many disc-like media such as coins, medals (hereinafter, these disc-like media are called as "coins") and pays out coins one by one.

2. Description of Related Art

As the coin payout device mentioned above, for example as shown in Japanese Unexamined Publication No. 7-85333, it is known a coin payout device which is installed inside of a slot machine and pays out a predetermined number of coins to a coin tray provided at a prayer's side of the slot machine according to a winning combination won in a game. Generally, the coin payout device installed in the slot machine is basically constructed from a payout unit including a rotation plate (coin disc) in which a plurality of coin openings are formed along a circumference thereof, a drive motor for driving the rotation plate, a control circuit board for controlling rotation of the drive motor and a connector for supplying electric power to the drive motor and for transmitting a control signal to the control circuit board, the payout unit being assembled on a base, as shown in Japanese Unexamined Publication No. 7-85333. And a bucket for storing many coins is attached on the base support.

Further, generally speaking, in a game arcade that many slot machines mentioned above are adjacently arranged with each other, the coin payout device which pays out coins by inserting a bill or a prepaid card is arranged between the slot machines. In this case, the coin payout device is assembled inside of the device (this type of device is called "sandwitched device") arranged between the adjacent slot machines, and such coin payout device pays out a predetermined number of coins corresponding to demand of the prayer.

Here, as mentioned, there are two types of the coin payout devices, one type of which is assembled inside of the slot machine and the other type of which is assembled inside of the above "sandwiched device". And since there exists space restriction when the outer device is attached to the slot machine, the coin payout device assembled inside of the slot machine and the coin payout device assembled in the "sandwitched device" have to be differently constructed because the space restriction in both the slot machine and the "sandwiched device" is very different with each other. That is to say, in particular, influence of the space restriction remarkably appears in the bucket portion for storing many coins. Concretely, the coin payout device for the slot machine has a shape that the height becomes low and both the width and the depth become wide, and on the contrary, the coin payout device for the "sandwitched device" has a shape that the height becomes high and both the width and the depth become narrow. Further, similarly in the coin disc, it can be utilized a disc plate with a large diameter (in which eight coin openings are formed) as the coin disc in the coin payout device for the slot machine, and on the contrary, it is necessary to utilize a disc plate with a small diameter (in which four coin openings are formed) as the coin disc in the coin payout device for the "sandwitched device". Namely, both the coin payout devices are exclusively designed with each other considering the specific situation of the device in which the coin payout devices are installed respectively. Therefore, there is no consideration to commonly use the parts in both two types of the above coin payout devices, as a result, there exists a problem that increase in cost of the coin payout device cannot be avoided.

And taking the above situation into consideration, it is desirable to consider assembly convenience and general purpose such that the coin payout device can be assembled in not only the slot machine but also the other device (for example, the "sandwitched device" arranged between the slot machines).

SUMMARY OF THE INVENTION

The present invention has been done to accomplish the above problems and provides a coin payout device which is able to be assembled in different outer devices, thereby decrease in cost thereof can be realized.

In order to accomplish the above problems, according to one aspect of the present invention, it is provided a coin payout device comprising:

a payout unit provided with a rotation plate in which a plurality of coin openings are formed along a circumference thereof, a drive motor for driving the rotation plate and a connector for supplying electric power to the drive motor, the payout unit paying out coins one by one;

a bucket for storing coins, the bucket being positioned on the payout unit; and a base to which the payout unit and the bucket are detachably arranged.

In the above coin payout device, since the coin payout device is constructed form three units of the bucket, the payout unit and the base, the payout unit can be commonly utilized when the coin payout device is assembled in various outer devices. Further, the payout unit can be adopted for various outer devices by only changing the bucket and the base while simply considering size or space of the outer device to which the payout unit is assembled. That is to say, the payout unit, which is the most expensive in the coin payout device, can be commonly utilized and the payout unit can be adopted for various outer devices by changing the bucket and the base which are made of resin and very cheep. As a result, cost of the coin payout device can be reduced.

Further, according to another aspect of the present invention, it is provided a coin payout device comprising:

a payout unit provided with a rotation plate in which a plurality of openings are formed along a circumference thereof, a drive motor for driving the rotation plate and a connector for supplying electric power to the drive motor, the payout unit paying out coins one by one;

a bucket for storing coins, the bucket being detachably arranged on the payout unit; and a base to which the payout unit is detachably arranged.

Similar to the above mentioned coin payout device, since the coin payout device is constructed form three units of the bucket, the payout unit and the base, the payout unit can be commonly utilized when the coin payout device is assembled in various outer devices. Further, the payout unit can be adopted for various outer devices by only changing the bucket and the base while simply considering size or space of the outer device to which the payout unit is assembled. That is to say, the payout unit, which is the most expensive in the coin payout device, can be commonly utilized and the payout unit can be adopted for various outer devices by changing the bucket and the base which are made of resin and very cheep. As a result, cost of the coin payout device can be reduced.

Here, it may be enough that the above three units are constructed so as to be able to separate with each other and to assemble into one-piece construction. And it may be enough that the payout unit and the bucket can be detachably assembled to the base, and the base and the bucket can be detachably assembled to the payout unit. Further, the payout unit may include elements other than the above elements (the rotation plate, the drive motor and the connector).

As mentioned above, according to the present invention, the payout unit, which is the most expensive, can be commonly utilized, for example, in both the coin payout device for the slot machine and the coin payout device for the "sandwitched device", therefore the coin payout device of the present invention can be adopted for various outer devices by changing the bucket and the base which are very cheep. As a result, cost of the coin payout device can be reduced.

Further, according to further another aspect of the present invention, it is provided a coin payout device comprising:

a bucket for storing coins, the bucket having an opening at a lower part thereof;

a payout unit for paying out coins one by one, the coins being supplied from the opening of the bucket; and a base to which the payout unit is detachably arranged;

wherein the payout unit comprises a frame, a rotation plate in which a plurality of coin openings are formed along a circumference thereof and which is rotatably supported in the frame, and a drive motor for driving the rotation plate, the drive motor being constructed so as to be detachable from the frame through a latch mechanism; and wherein limit members for limiting spread of the latch mechanism by engaging with the latch mechanism when the payout unit is arranged on the base.

According to the above coin payout device, since the drive motor is arranged in the frame of the payout unit through the latch mechanism, assembling ability and maintenance ability can be improved. And when the payout unit is assembled to the base, the latch mechanism is limited so as not to spread by the limit members formed in the base, the drive motor can be prevented from dropping due to that the latch mechanism is falsely spread by a shock occurring when the payout unit is hit to the other thing.

According to the above mentioned coin payout device of the present invention, assembling ability and maintenance ability of the drive motor can be improved and even if strong shock is added to the coin payout device, the heavy drive motor can be prevented from dropping due to that the latch mechanism, which makes the drive motor detachable, is falsely spread.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention.

In the drawings,

FIG. 4 shows the payout unit.

DETAILED DESCRIPTION OF THE PREFERRED EMBODIMENTS

Figure 1:
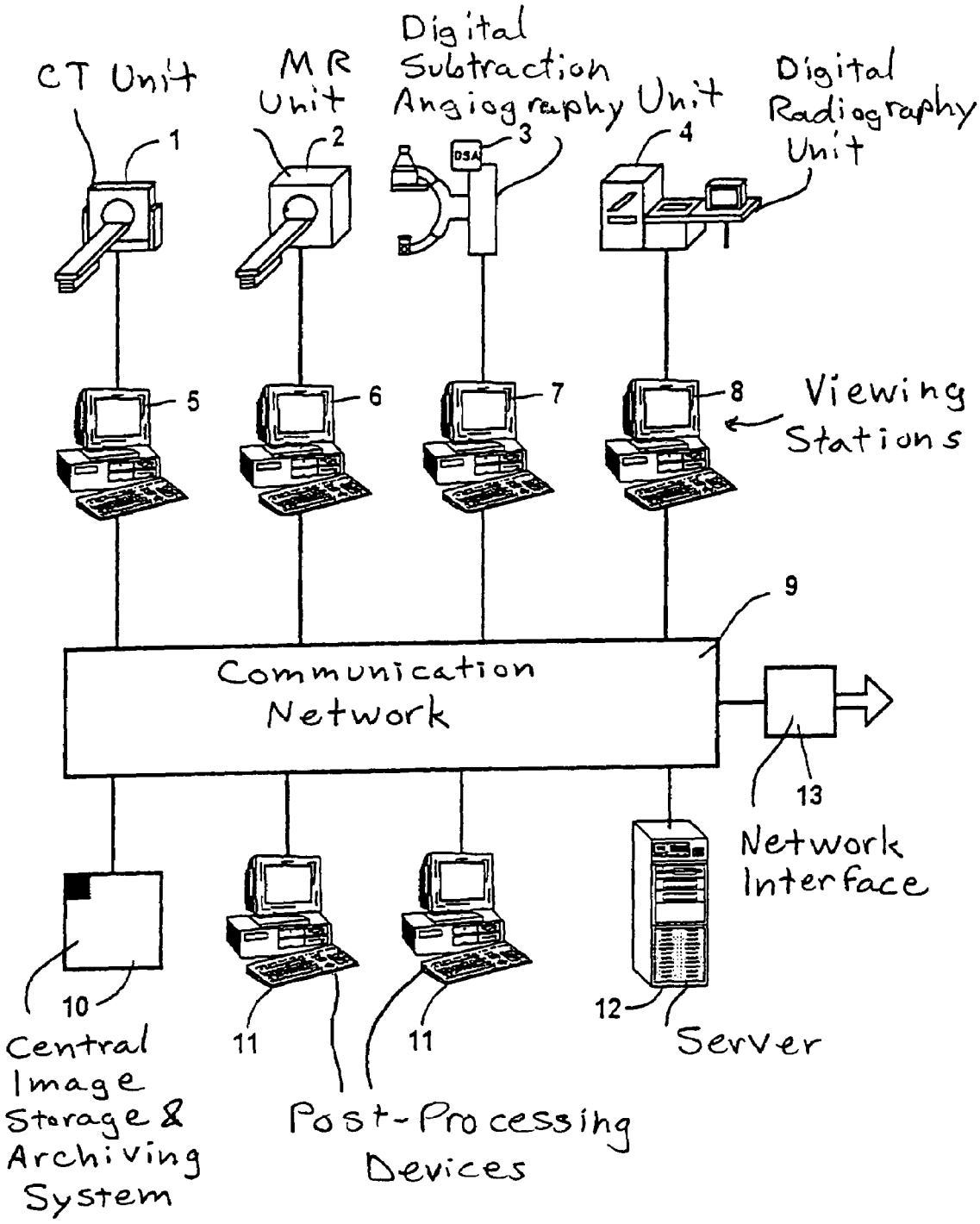
FIG. 1 is a perspective view showing one embodiment of a coin payout device according to the present invention.
Figure 2:
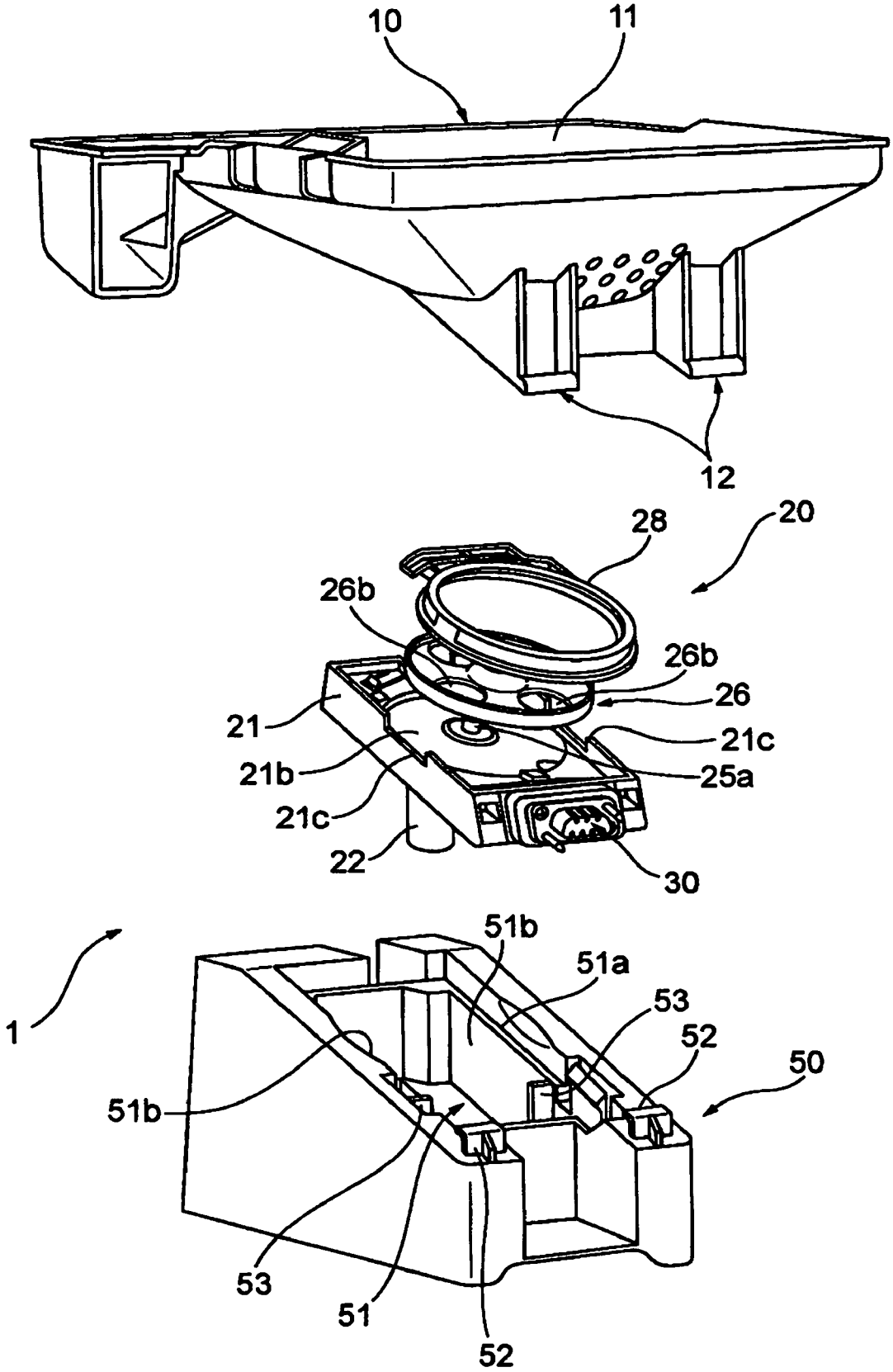
FIG. 2 is an exploded perspective view of the coin payout device shown in FIG. 1.
Figure 3:
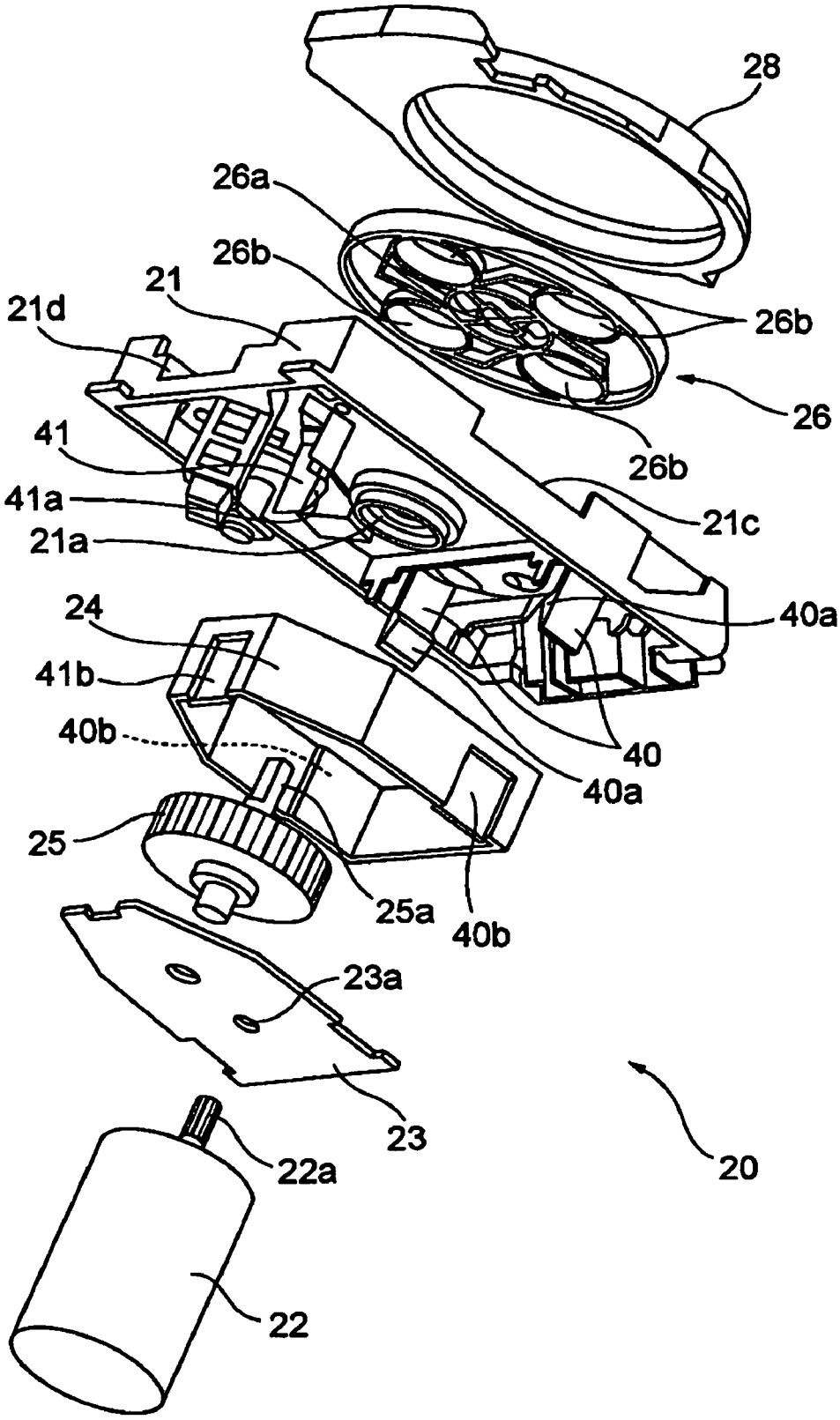
FIG. 3 is an exploded perspective view of a payout unit.
Figure 4A:
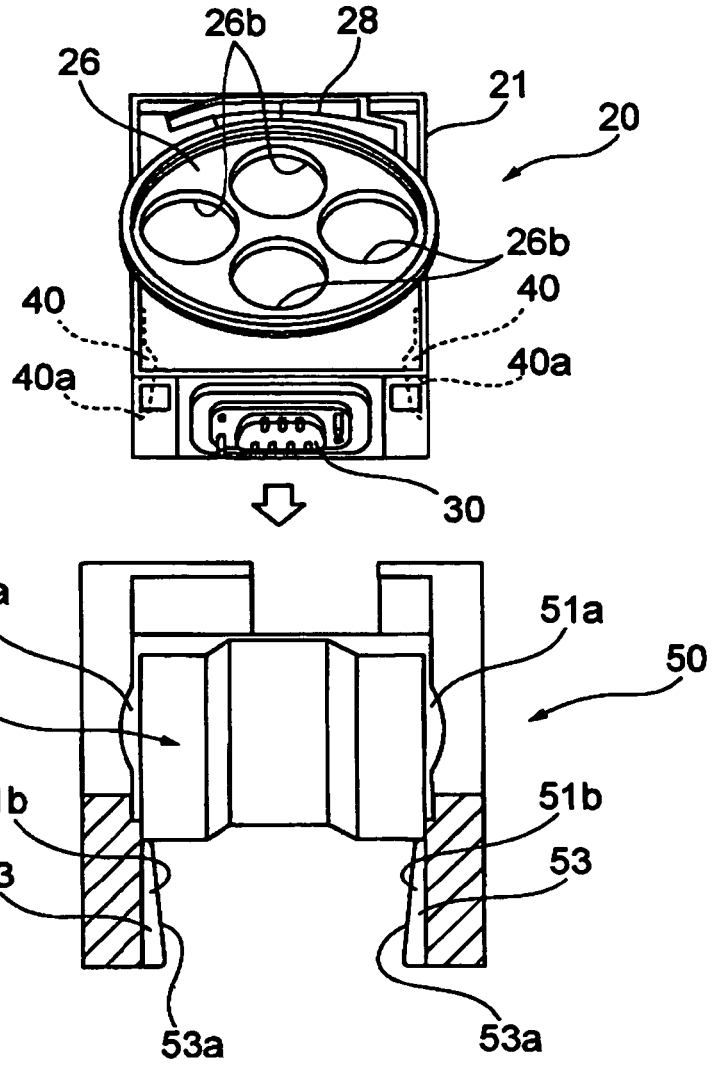
FIG. 4A is a front view showing a state that the payout unit is assembled on a base and FIG. 4B is a front view showing the payout unit assembled on the base.
Figure 4B:
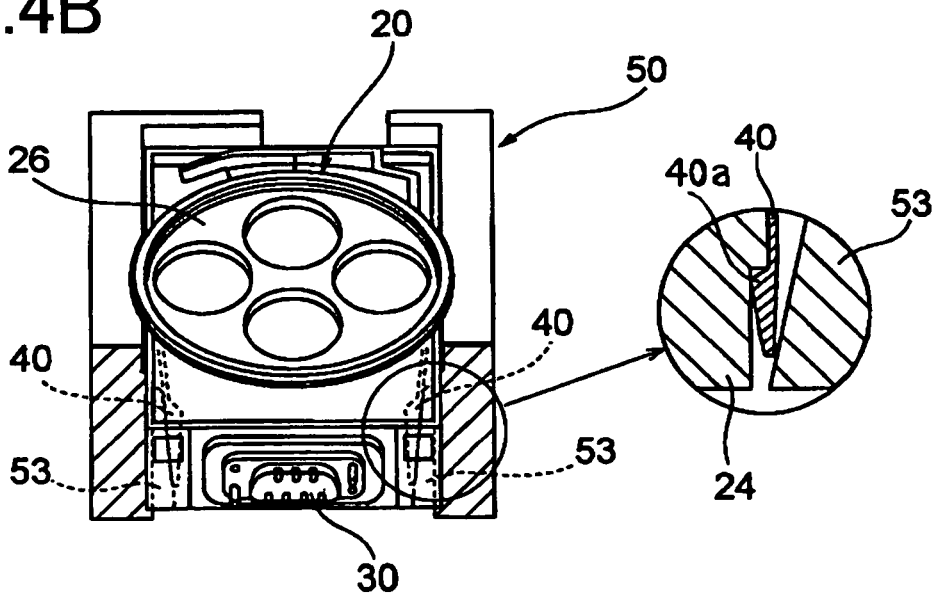

Hereinafter, one embodiment of the coin payout device according to the present invention will be described with reference to FIGS. 1–4. Here, FIG. 1 is a perspective view showing whole construction of the coin payout device, FIG. 2 is an exploded perspective view of the coin payout device shown in FIG. 1, FIG. 3 is an exploded perspective view of the payout unit, and FIG. 4A is a front view showing a state that the payout unit is assembled on a base and FIG. 4B is a front view showing the payout unit assembled on the base (the base portion is sectioned at a position where ribs are formed).

The coin payout device 1 is constructed from three units of a bucket 10 for storing many coins, a payout unit 20 for paying out one by one coins stored in the bucket 10 and a base 50 installed in various devices such as the slot machine body or the "sandwitched device". And each unit is detachably constructed.

The above bucket 10 has a storing portion 11 in which many coins actually paid out are stored and a pair of engagement portions 12 which are constructed so as to detachably engage with the base 50 under the storing portion 11. The storing portion 11 and the engagement portions 12 are made of resin into one-piece construction. And an opening (not shown) is formed at the bottom part of the storing portion 11 and coins are sent to the payout unit 20 through the above opening.

The payout unit 20 has function to pay out coins one by one while retaining coins in a predetermined posture and has a rectangular frame (payout base) 21 positioned in an oblique state against the horizontal plane. The frame 21 is made of resin into one-piece construction, and to the backside thereof, it is detachably attached a drive motor 22 which is positioned on a motor plate 23 and has a gear case 24.

In this case, the drive motor 22 is attached to and detached from the frame 21 by operating a latch mechanism, without using screws and the like. Concretely, the latch mechanism is integrally formed in the frame 21 and the latch mechanism is constructed from three resilient deformable members 40, 40, 41 which are projected in the downward direction. Among the resilient deformable members, the resilient deformable members 40, 40 are formed so as to correspond to the left and right wall planes of the gear case 24 which is attached to the frame 22 when the payout unit is seen from the front side thereof. And the resilient deformable member 41 is formed so as to correspond to the wall plane of the deepest side in the gear case 24 which is attached to the frame 21 when the payout unit is seen from the front side thereof. Further, at the top ends of the resilient deformable members 40, 40, 41, engagement pawls 40*a*, 40*a*, 41*a* are formed so as to face toward inner side.

On the outer wall planes of the gear case 24, recess portions 40*b*, 40*b*, 41*b* are formed at positions corresponding to the resilient deformable members 40, 40, 41 of the frame 21, the recess portions 40*b*, 40*b*, 41*b* guiding the resilient deformable members 40, 40, 41. The gear case 24 (the drive motor 22) is attached to the frame 21 by positioning the recess portions 40*b*, 40*b*, 41*b* with the resilient deformable members 40, 40, 41, respectively. At that time, when the gear case 24 is attached to the frame 21, the resilient deformable members 40, 40, 41 are guided along the recess portions 40*b*, 40*b*, 41*b* while being slightly spread and the engagement pawls 40*a*, 40*a*, 41*a* of the resilient deformable members 40, 40 41 are correspondingly engaged with the lower ends of the recess portions 40*b*, 40*b*, 41*b*. Thereby, the drive motor 22 is attached to the frame 21 without using screws and the like. And the above engaging state of the engagement pawls 40*a*, 40*a*, 41*a* is removed by further spreading the resilient deformable members 40, 40, 41, thus the drive motor 22 is detached from the frame 21.

An output shaft 22*a* of the drive motor 22 is passed through a hole 23*a* of the motor plate 23 and is meshed with a reduction gear arranged in the gear case 24. Rotational driving force of the output shaft 22*a* is transmitted to a coin disc (mentioned later) under a state that rotation speed thereof is reduced. And from the reduction gear 25 arranged in the gear case 24, a rotation shaft 25*a* is projected upward and a section of the rotational shaft 25*a* is formed in a non-circular shape. The rotation shaft 25*a* is projected from the surface of the frame 21 through a hole 21*a*.

On the upper surface of the frame 21, a circular recess portion 21*b* is formed and the hole 21*a* is positioned at the center of the recess portion 21*b*. The coin disc (rotation plate) 26 is detachably arranged. At the center of the coin disc 26, it is formed an engagement hole 26*a* through which the rotation shaft 25*a* of the reduction gear 25 is engaged so that the rotation shaft 25*a* does not rotate. And along the circumference of the coin disc 26, a plurality of coin openings 26*b* (in the embodiment, four coin openings 26*b* are formed), each coin opening 26 receiving coin therein, are formed. Further, a press member 28 for pressing the coin disc 26 from the upper side thereof is arranged under a state that the coin disc 26 is set to the rotation shaft 25*a* so as not to rotate. Here, in the embodiment, at both sides of the frame 21, cutouts 21*c* are formed at positions that the coin disc 26 is interfere with the side walls, thereby body of the frame 21 is miniaturized in a width direction thereof as possible as it can.

And to the frame 21, a connector 30 is provided so as to be exposed, and electric power is supplied to the drive motor 22 through the connector 30, and a control circuit board (not shown) for controlling the drive motor 22 is connected to a main circuit board of an outer device through the connector 30, thereby transmission-reception of control signals are conducted therebetween. Further, when a signal indicating a number of coins to be paid out is input from the outer device to the control circuit board through the connector 30, the drive motor 22 is driven and payout of coins is conducted.

Coins stored in the storing portion 11 are positioned within the coin openings 26*b* of the coin disc 26 through the opening of the bottom part, and based on that the coin disc 26 is driven to rotate, coins are paid out one by one from the space 21*d* existing between the frame 21 and the coin disc 26 by a press-out mechanism which is generally known. In the payout path of coins, coin detector such as a photo sensor is positioned, and at the time that the payout number of coins detected by the coin detector coincides with the signal indicating the number of coins to be paid out, driving of the drive motor 22 is stopped. Thereby, coin payout treatment for one time is completed.

The base 50 has a recess portion 51 in which the payout unit 20 is detachably set and oblique planes 51*a* to hold the payout unit 20 in an oblique state are formed, and a pair of engagement pawls 52 to which the pair of engagement portions 12 of the bucket 10 are detachably engaged. The recess portion 51 and the engagement pawls 52 are integrally formed into one-piece construction.

Here, the payout unit 20 may be positioned and retained to the base 50 in a state that the payout unit 20 is simply piled on the base 50. And the payout unit 20 may be positioned and retained through another fixing screws or detachable mechanism. Further, the bucket 10 may be positioned and retained to the base 50 by screws and the like, in addition that the bucket 10 is detachably arranged to the base 50 by engagement between the engagement portions 12 and the engagement pawls 52.

Further, to both the inner walls 51*b* among the inner walls forming the recess portion 51, limit members 53 are formed so as to engage the resilient deformable members 40, 40 of the payout unit 20 which is set in the recess portion 51. As shown in FIG. 4A, the limit members 53 are formed as ribs so as to project toward inner sides and extend along the vertical direction. When the payout unit 20 is set to the recess portion 51, the limit members 53 contact to surfaces of the resilient deformable members 40, 40 and limit them so as not to spread in excess of predetermined extent.

In this case, in order to certainly limit spread of the resilient deformable members 40, 40, it is preferable that contact surfaces 53*a* of the limit members 53 are formed so as to oblique toward the inner sides according that the contact surfaces 53*a* go down, as shown in FIG. 4A. And there is no need to form the limit members 53 corresponding to all of the resilient deformable members 40, 40, 41 and it is enough that the limit members 53 are formed at positions where the limit members 53 contact to predetermined resilient deformable members and drop of the drive motor 22 can be effectively prevented.

According to the above construction, three units 10, 20 and 50 are assembled in the state shown in FIG. 1 and the payout unit 20 is arranged in the space between the bucket 10 and the base 50 while only the connector 30 is exposed. And when the payout unit 20 is assembled to the base 50, the resilient deformable members 40, 40 are limited so as not to spread by the limit members 53 formed on both the inner walls 51*b* of the recess portion 51 in the base 50, as shown in FIG. 4B, therefore the drive motor 22 arranged to the payout unit 20 through the latch mechanism can be prevented from dropping due to that the latch mechanism is falsely spread by a shock occurring when the payout unit 20 is hit to the other thing.

Further, in the above constructed coin payout device, since three units of the bucket 10, the payout unit 20 and the base 50 are constructed so as to be able to separate with each other, the payout unit 20, which is the most expensive, can be commonly utilized in the coin payout device which is assembled in different devices. That is to say, there is no need to design the payout unit taking into consideration characteristic of the base portion in the coin payout device for the slot machine or for the "sandwitched device" and the payout unit can be adopted for various devices by only changing cheep bucket 10 or base 50 which can be made of resin into one-piece construction while simply considering size or space of the outer device to which the payout unit is assembled. As a result, cost of the coin payout device can be reduced.

Although the embodiment of the present invention is explained in the above, concerning with the shape and construction of each unit, the present invention is not limited to the embodiment shown in Figs. and various modifications can be done within the scope of the present invention, in a case that the drive motor 22 set in the payout unit is detachably constructed through the latch mechanism and spread of the latch mechanism is limited by the limit members 53 formed in the base 50 when the payout unit is assembled to the base 50. For example, the payout unit 20 may be positioned and retained under a state that the payout unit 20 is simply piled on the base 50. And the payout unit 20 may be positioned and retained through another fixing screws or detachable mechanism.

Further, concerning with the shape and the construction of each unit, the present invention is not limited to the embodiment shown in Figs. and various modifications can be done within the scope of the present invention, in a case that three units of the bucket 10 which stores coins therein, the payout unit 20 to pay out coins and the base 50 arranged in the outer device are constructed so as to separate with each other. For example, the number of the coin openings 26*b* of the coin disc 26 in the payout unit 20, the position of the connector 30, retaining state of the payout unit 20 on the base 50 and detachable mechanism of three units can be flexibly modified.

Further, in the above embodiment, although the bucket 10 and the payout unit 20 are detachably constructed against the base 50, the bucket 10 may be detachably constructed to the payout unit 20 and the payout unit 20 may be attached to the lower portion of the bucket 10 and the bucket 10 constructed into one-piece with the payout unit 20 may be attached to the base 50.

Further, in the above embodiment, although the resilient deformable members 40, 40, 41 constructing the latch mechanism are formed in the frame 21, such resilient deformable members may be formed in the side of the drive motor (side of the gear case). In addition, the position that the latch mechanism is arranged and the number of the latch mechanism may be flexibly modified. And concerning with the limit members formed in the inner side walls of the base, the shape thereof may be flexibly modified if it can effectively prevent the drive motor from being dropped. Further, as in the embodiment, there is no need to form the limit members corresponding to all resilient deformable members of the latch mechanism.

The present invention may be applied to a cash payout device for paying out coins, in addition to the coin (game medium) payout device in the slot machine or the "sandwitched device".

What is claimed is:

1. A coin payout device comprising:

a payout unit provided with a rotation plate in which a plurality of coin openings are formed along a circumference thereof, a frame rotatably supporting the rotation plate and a drive motor for driving the rotation plate the payout unit paying out coins one by one;

a bucket for storing coins, the bucket having an engagement portion formed therein and being positioned on the payout unit; and a base provided with a recess portion for retaining the frame and an engagement pawl with which the engagement portion of the bucket is engaged.

2. The coin payout device according to claim 1, further comprising:

an oblique plane formed in the recess portion of the base;

wherein the payout unit is detachably arranged to the recess portion and retained on the oblique plane in an oblique state.

3. The coin payout device according to claim 2, wherein the payout unit, the bucket and the base are separable with each other.

4. The coin payout device according to claim 1, wherein the engagement portion is integrally formed in the bucket and the engagement pawl is integrally formed in the base.

5. The coin payout device according to claim 1, wherein cutouts are formed in a pair of side walls in the frame, the side walls facing with each other.

6. The coin payout device according to claim 5, further comprising:

a case member supporting the drive motor; and a latch mechanism arranged between the frame and the case member.

7. The coin payout device according to claim 6, wherein the latch mechanism comprises:

a plurality of resilient engagement members integrally formed in the frame, each of the resilient engagement members having an engagement pawl at one end thereof;

recess engagement portions to one of which each of the resilient engagement members is engaged, the recess engagement portions being formed in side walls of the case member;

wherein the engagement pawl of each of the resilient engagement members is engaged at a lower end of the recess engagement portion.

8. The coin payout device according to claim 7, further comprising:

limit members formed in side walls of a recess portion in the base corresponding to the resilient engagement members;

wherein the limit members are contacted to the resilient engagement members when the payout unit is arranged in the recess portion while the engagement pawl of each of the resilient engagement members is engaged at the lower end of the recess engagement portion.

9. The coin payout device according to claim 8, wherein the limit member is constructed from a rib having an oblique plane which obliques toward an inner side of the recess portion according that the oblique plane goes down.

10. A coin payout device comprising:

a bucket for storing coins, the bucket having an opening at a lower part thereof;

a payout unit for paying out coins one by one, the coins being supplied from the opening of the bucket; and a base to which the payout unit is detachably arranged;

wherein the payout unit comprises a frame, a rotation plate in which a plurality of coin openings are formed along a circumference thereof and which is rotatably supported in the frame, and a drive motor for driving the rotation plate, the drive motor being constructed so as to be detachable from the frame through a latch mechanism; and wherein limit members for limiting spread of the latch mechanism by engaging with the latch mechanism when the payout unit is arranged on the base.

11. The coin payout device according to claim 10, wherein the latch mechanism comprises a plurality of resilient engagement members which are integrally formed in the frame and each of which has an engagement pawl at one end thereof, and recess engagement portions formed in side walls of a case member which rotatably supports the drive motor, each of the resilient engagement members being engaged with each of the recess engagement portions, and wherein the engagement pawl of each of the resilient engagement members is engaged at a lower end of the recess engagement portion.

12. The coin payout device according to claim 11, wherein the limit members are formed in side walls of a recess portion in the base corresponding to the resilient engagement members, and wherein the limit members are contacted to the resilient engagement members when the payout unit is arranged in the recess portion while the engagement pawi of each of the resilient engagement members is engaged at the lower end of the recess engagement portion.

13. The coin payout device according to claim 12, wherein the limit member is constructed from a rib having an oblique plane which obliques toward an inner side of the recess portion according that the oblique plane goes down.

* * * * *